US006942956B2

(12) United States Patent
Simpson et al.

(10) Patent No.: US 6,942,956 B2
(45) **Date of Patent: *Sep. 13, 2005**

(54) PROCESS OF TRANSFERRING TRANSFERABLE PROTECTION OVERCOAT TO A DYE-DONOR ELEMENT

(75) Inventors: William H. Simpson, Pittsford, NY (US); Jacob J. Hastreiter, Spencerport, NY (US); Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/669,932

(22) Filed: Sep. 24, 2003

(65) Prior Publication Data

US 2005/0064319 A1 Mar. 24, 2005

(51) Int. Cl.[7] ..... G03C 8/00

(52) U.S. Cl. ..... 430/201; 430/200; 430/961; 156/234; 156/240; 503/227; 428/32.87

(58) Field of Search ..... 430/200, 201, 430/961; 428/32.87; 156/234, 240; 503/227

(56) References Cited

U.S. PATENT DOCUMENTS 4,522,881 A * 6/1985 Kobayashi et al. ..... 428/336
4,621,271 A 11/1986 Brownstein
5,332,713 A * 7/1994 Oldfield et al. ..... 503/227
5,789,067 A * 8/1998 Mizumachi et al. ..... 428/195.1
6,172,002 B1 * 1/2001 Saito et al. ..... 503/227
6,184,375 B1 * 2/2001 Huglin et al. ..... 544/116
6,733,611 B2 * 5/2004 Hayashi et al. ..... 156/230
2003/0165717 A1 9/2003 Hardin et al.
2003/0165753 A1 * 9/2003 Suzuki et al. ..... 430/14
2003/0176283 A1 * 9/2003 Simpson et al. ..... 503/227

FOREIGN PATENT DOCUMENTS

EP 0 982 150 A2 3/2000

* cited by examiner

*Primary Examiner*—Richard L. Schilling
(74) *Attorney, Agent, or Firm*—Kathleen Neuner Manne

(57) ABSTRACT

A process of transferring a protection layer from a dye-donor receiver after thermal dye transfer. In one embodiment, the transferable protection layer contains inorganic particles, a polymeric binder, organic particles and an organic gloss-enhancing agent that enhances the gloss of the final print. The transferred protection layer that provides a higher gloss to an image after transfer. A laminate containing such a gloss-enhancing agent has been found to enable printing at lower line times, faster printing, for thermal prints withwhile maintaining high gloss.

17 Claims, No Drawings

PROCESS OF TRANSFERRING TRANSFERABLE PROTECTION OVERCOAT TO A DYE-DONOR ELEMENT

FIELD OF THE INVENTION

This invention relates to a process of transferring a transparent protective overcoat to a dye-donor element after thermal dye transfer. In particular, the invention improves the process of providing an improved level of gloss to the transferred protective layer by the use of a gloss-enhancing agent.

BACKGROUND OF THE INVENTION

In recent years, thermal transfer systems have been developed to obtain prints from pictures that have been generated electronically from a color camera. According to one way of obtaining such prints, an electronic picture is first subjected to color separation by color filters. The respective color-separated images are then converted into electrical signals. These signals are then operated on to produce cyan, magenta and yellow signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. This is due to dye being at the surface of the dye-receiving layer of the print. These dyes can be driven further into the dye-receiving layer by thermally fusing the print with either hot rollers or a thermal head. This will help to reduce dye retransfer and fingerprint susceptibility, but does not eliminate problems. However, the application of a protection overcoat will practically eliminate these problems. This protection overcoat is applied to the receiver element by heating in a likewise manner after the dyes have been transferred. The protection overcoat will improve the stability of the image to light fade and oil from fingerprints.

Exposure of dyes to ultraviolet light (light with wavelengths less than 400 nm) usually results in degradation, or fading, of dyes with time. The degradation can be caused by photolysis, which is the direct absorption of the ultraviolet light. The dye can also degrade by either photooxidation or photoreduction depending on the chemical structure of the dye and of the natural or man-made polymer surrounding the dye. It is common to include a UV absorbing material in a heat-transferable protective overcoat layer for a dye-diffusion thermal transfer print as taught in U.S. Pat. No. 4,522,881 to reduce the rate of dye fading from ultraviolet light. Protection of the printed image from UV light should not degrade the stability of the image to daylight, which has a much lower intensity of UV light.

U.S. Pat. No. 6,184,375 suggests the use of triazine UV absorbers for a broad range of uses. It is suggested to employ such materials in various locations such as the receiver layer or in the overcoat as described in EP 505,734.

Copending commonly assigned U.S. Patent Application Publication US 2003/0176283A1, hereby incorporated by reference, discloses a heat transferred protective overcoat comprising a hydroxyphenyl triazine compound in a polymeric binder which overcoat has been placed over the image on a thermal dye sublimation receiving element and which overcoat provides UV protection without degrading daylight protection.

In a thermal dye transfer printing process, it is desirable for the finished prints to compare favorably with color photographic prints in terms of image quality. The look of the final print is very dependent on the surface texture and gloss. Typically, color photographic prints are available in surface finishes ranging from very smooth, high gloss to rough, low gloss matte.

The transferable protection layer of the dye donor that has a glossy finish is manufactured by a gravure coating process between the temperatures of 55° F. and 120° F., preferably between 65° F. and 100° F. A coating melt or solution is prepared from a solvent soluble polymer, a colloidal silica and organic particles and is transferred in the liquid state from the etching of the gravure cylinder to the dye donor support. The coated layer is dried by evaporating the solvent.

The transferable protection layer is usually one of at least two patches on the dye donor. It is transferred after printing an image from the dye donor to the surface of the dye-receiving layer of the receiver by heating the backside of the donor causing the transferable protection layer to adhere to the dye-receiving layer. The dye donor is peeled away from the receiver after cooling resulting in transfer of the protective layer. The surface of the transferred protective layer adhered to the dye-receiving layer has a measurable 60 degree gloss that is usually between 65 and 85 gloss units.

It has been found that the gloss on a laminated print decreases as the printing line time decreases, which is a problem as printing times become faster.

SUMMARY OF THE INVENTION

A solution to this problem is achieved in accordance with the process of this invention, which relates to a process of transferring a protection layer to a dye-donor receiver element after thermal dye transfer at fast print times. The final product of the process comprises a support having thereon at least one dye layer area comprising an image dye in a binder and another area comprising a transferable protection layer, the transferable protection layer area being approximately equal in size to the dye layer area.

In one embodiment, the transferable protection layer contains inorganic particles, a polymeric binder, and organic particles, and a gloss-enhancing agent. Preferred gloss-enhancing agents include compounds such as a triazine or benzotriazole for enhancing the gloss of the final print. Thus, the use of such gloss-enhancing agents, including certain UV absorbers, have been found to enable printing at lower line times, faster printing, while maintaining high gloss.

In one embodiment, incorporation of a gloss-enhancing agent into the fourth patch laminate of a thermal donor results in a higher gloss on the print after the laminate has been transferred to the receiver when compared to the control without the agent.

DETAILED DESCRIPTION OF THE INVENTION

As indicated above, the present invention relates to a process of forming a protection layer with an improved level of gloss on top of a thermal dye transfer image comprising: (a) imagewise-heating a dye-donor element comprising a support having thereon a dye layer comprising an image dye in a binder, said dye donor being in contact with a dye-receiving element, thereby transferring a dye image to said dye-receiving element at a line time of 0.4 to 2 milliseconds, preferably 0.5 to 1.4 milliseconds, more preferably 0.5 to 1.0 milliseconds, to form said dye transfer image; and (b) thermally transferring a protection layer on top of said transferred dye image at a line time, not necessarily the same as in step (a), of 0.4 to 2 milliseconds, preferably 0.5 to 1.4 milliseconds, more preferably 0.5 to 1.0 milliseconds; said protection layer comprising an effective amount of a gloss-enhancing agent that is an organic compound that is essentially colorless, does not scatter light, substantially non-light-absorbing from 400 to 800 nm, and having a maximum absorption at a wavelength less than 400 nm.

In the preferred embodiment, the gloss of the transferred protection layer is less than 69 in the absence of the gloss-enhancing agent and at least 72 to 85 or greater, preferably 75 to 80 in the presence of the gloss-enhancing agent. An improvement of at least 2 gloss units as measured by the Gloss Test (described in the Example), preferably at least 3 gloss units is especially desired.

Examples of gloss-enhancing agents include certain, but not all UV-absorbing agents. Preferred gloss-enhancing agents are selected benzotriazole or triazine compounds. Gloss-enhancing agents, however, are not limited to known or commercially used UV absorbers, but can be any organic compound, including polymers that have the required properties.

In one particular preferred embodiment, the gloss-enhancing agent is a hydroxyphenyl triazine compound, also useful as a UV absorber, which compound is generally represented by Formula I:

I

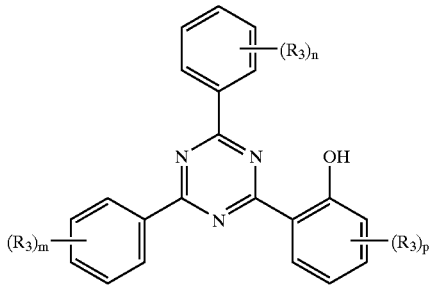

In Formula I, each $R_3$ is independently a substituent and m, n, and p are each 0 to 3. Suitably, each R subscripted group present is an alkyl, alkoxy, or hydroxy group. Ester containing substituents are useful. U.S. Pat. No. 6,184,375 describes numerous examples of specific useful compounds.

More specific formulas for useful compounds are given by Formulas I' and I" below:

I'

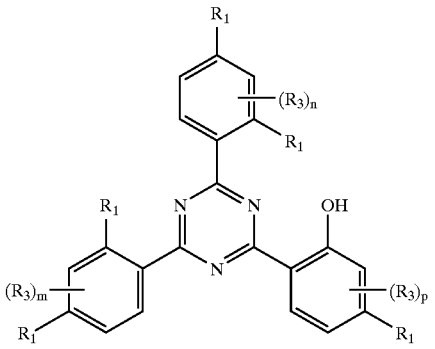

wherein each $R_1$ is independently a substituent and each $R_3$ is a substituent and m, n, and p are independently each 0 to 2. Suitably, each R subscripted group present is an alkyl, alkoxy, or hydroxy group.

II"

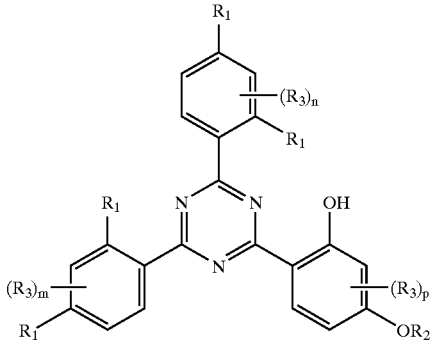

wherein $R_2$ is an alkyl group of up to 8 carbon atoms, each $R_1$ is a substituent, and each $R_3$ is a substituent and m, n, and p are each 0 to 2. Suitably, each $R_1$ and each $R_3$ group present is an alkyl, alkoxy, or hydroxy group.

A particularly useful compound is represented by Formula II below:

II

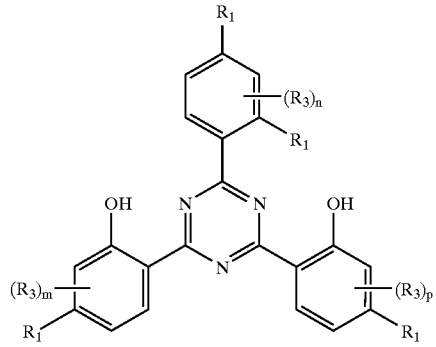

wherein each $R_1$ is a substituent, and each $R_3$ is a substituent and m, n, and p are each 0 to 2. Suitably, each R subscripted group present is an alkyl, alkoxy, or hydroxy group.

Compounds as in Formula II in which all $R_1$ groups are hydroxy or n-butoxy groups can be employed.

Unless otherwise specifically stated, use of the term "group", "substituted" or "substituent" means any group or radical other than hydrogen. Additionally, when reference is made in this application to a compound or group that contains a substitutable hydrogen, it is also intended to encompass not only the unsubstituted form, but also its form further substituted with any substituent group or groups as herein mentioned, so long as the substituent does not destroy properties necessary for the intended utility. The particular substituents used may be selected by those skilled in the art to attain the desired desirable properties for a specific application and can include, for example, hydrophobic groups, and solubilizing groups. When a molecule may have two or more substituents, the substituents may be joined together to form a ring such as a fused ring unless otherwise provided.

Specific examples of some useful gloss-enhancing compounds are:

I-1

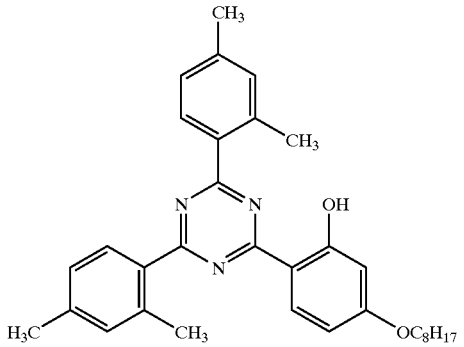

I-2

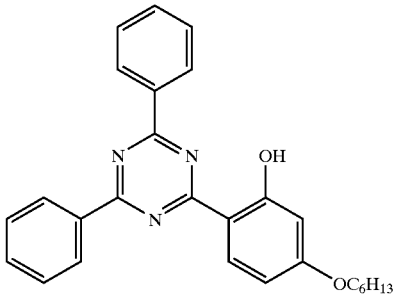

I-3

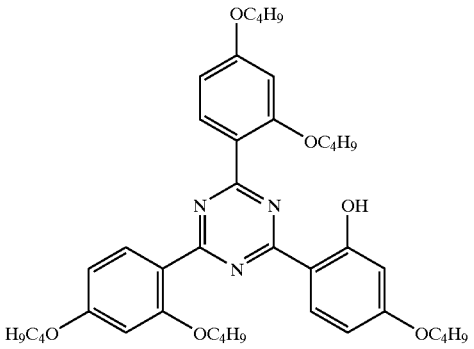

II-a

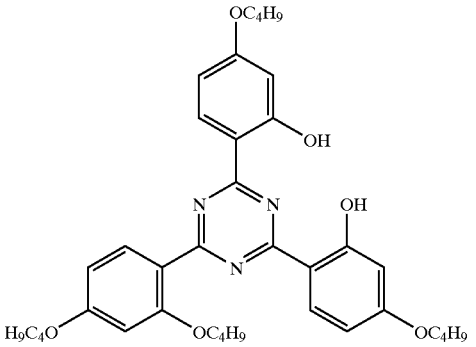

-continued

II-b

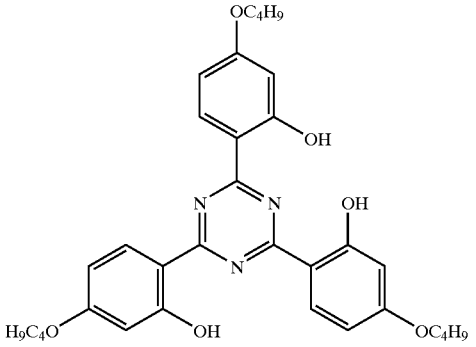

In a preferred embodiment of the invention, the dye-donor element is a multicolor element comprising repeating color patches of yellow, magenta and cyan image dyes, respectively, dispersed in a binder, and a patch containing the protection layer. Preferably, the protection layer or overcoat is transferred over an image made from a single thermal head. In one embodiment, the invention is used in a kiosk.

In another embodiment of the present process, the dye-donor element is a monochrome element and comprises repeating units of two areas, the first area comprising a layer of one image dye dispersed in a binder, and the second area comprising the protection layer.

In still another embodiment of the present process, the dye-donor element is a black-and-white element and comprises repeating units of two areas, the first area comprising a layer of a mixture of image dyes dispersed in a binder to produce a neutral color, and the second area comprising the protection layer.

The present process provides a protection overcoat layer on a thermal print by uniform application of heat using a thermal head. After transfer to the thermal print, the protection layer provides superior protection against image deterioration due to exposure to light, common chemicals, such as grease and oil from fingerprints, and plasticizers from film album pages or sleeves made of poly(vinyl chloride). The protection layer is generally applied at coverage of at least about 0.03 $g/m^2$ to about 1.7 $g/m^2$ to obtain a dried layer of preferably less than 1 $\mu$m.

As noted above, the transferable protection layer comprises inorganic and organic particles dispersed in a polymeric binder. Many such polymeric binders have been previously disclosed for use in protection layers. Examples of such binders include those materials disclosed in U.S. Pat. No. 5,332,713, the disclosure of which is hereby incorporated by reference. In a preferred embodiment of the invention, poly(vinyl acetal) is employed.

Preferably, the transferable protection layer area being approximately equal in size to the dye layer area, wherein the transferable protection layer comprises poly(vinyl formal), poly(vinyl benzal) or poly(vinyl acetal) containing at least about 5 mole % hydroxyl.

In a preferred embodiment of the invention, the protection layer comprises:

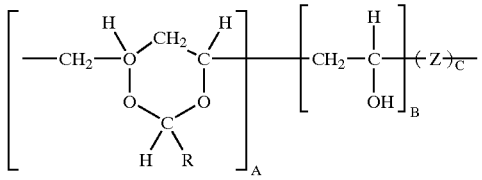

wherein:

R is H, $CH_3$ or $C_6H_5$;

A is at least about 25 mole percent;

B is from about 5 to about 75 mole percent;

Z is another monomer different from A and B such as vinyl acetate, vinyl chloride, styrene, methyl methacrylate, butyl acrylate, isopropyl acrylamide, and acrylate ionomer;

A+B is at least about 65 mole percent; and $$A+B+C=100.$$

Preferably, the Tg of the surface material on the overcoat in contact with the print is in the range of 100 to 125° C., more preferably below 120° C., most preferably 110 to 120° C. Suitably, the protective overcoat is heated by the thermal head at a temperature of 130 to 150° C. This allows a gloss level of at least 70.

The present process preferably provides a protective overcoat layer applied to a thermal print by uniform application of heat using a single thermal head.

In use, yellow, magenta and cyan dyes are thermally transferred from a dye-donor element to form an image on the dye-receiving sheet. The thermal head is then used to transfer a clear protective layer, from another clear patch on the dye-donor element or from a separate donor element, onto the imaged receiving sheet by uniform application of heat. The clear protection layer adheres to the print and is released from the donor support in the area where heat is applied.

The clear protective layer adheres to the print and is released from the donor support in the area where heat is applied.

Binder materials for the protective overcoat include, for example, but are not limited to the following:

1) Poly(vinyl benzal) in 2-butanone solvent.

2) Poly(vinyl acetal) KS-5 (Sekisui Co) (26 mole % hydroxyl, 74 mole % acetal) in a 3-pentanone/methanol solvent mixture (75/25).

3) Poly(vinyl acetal) KS-3 (Sekisui Co) (12 mole % hydroxyl, 4 mole % acetate, 84 mole % acetal) in a 3-pentanone/methanol solvent mixture (75/25).

4) Poly(vinyl acetal) KS-I (Sekisui Co) (24 mole % hydroxyl, 76 mole % acetal) in a 3-pentanone/methanol solvent mixture (75/25).

5) Poly(vinyl acetal) (26 mole % hydroxyl, 74 mole % acetal) in a 3-pentanone/methanol solvent mixture (75/25).

6) Poly(vinyl acetal) (29 mole % hydroxyl, 71 mole % acetal) in a 3-pentanone/methanol solvent mixture (75/25).

7) Poly(vinyl acetal) (56 mole % hydroxyl, 44 mole % acetal) in a 3-pentanone/methanol solvent mixture (75/25).

8) Poly(vinyl acetal) (15 mole % hydroxyl, 77 mole % acetal, 8 mole % acetate) in a methanol/3-pentanone solvent mixture (75/25).

9) Poly(vinyl acetal) (20 mole % hydroxyl 51 mole % acetal, 29 mole % acetate) in a methanol/3-pentanone solvent mixture (75/25).

10) Poly(vinyl acetal) (24 mole % hydroxyl, 76 mole % acetal) in a methanol/3-pentanone solvent mixture (75/25).

11) Poly(vinyl acetal) (44 mole % hydroxyl, 43 mole % acetal, 13 mole % acetate) in a methanol/water solvent mixture (75/25).

12) Poly(vinyl acetal) (65 mole % hydroxyl, 35 mole % acetal) in a methanol/water solvent mixture (75/25).

13) Poly(vinyl acetal) (18 mole % hydroxyl, 64 mole % acetal, 18 mole % acetate) in a methanol/3-pentanone solvent mixture (75/25).

14) Poly(vinyl acetal) (16 mole % hydroxyl, 84 mole % acetal) in a methanol/3-pentanone solvent mixture (75/25).

15) Poly(vinyl formal) (Formvar®, Monsanto Co.) (5% hydroxyl, 82% formal, 13% acetate) in a toluene/3A alcohol/water mixture (57/40/3).

Preferably, inorganic particles are present in the protection layer used in the present process. There may be used, for example, silica, titania, alumina, antimony oxide, clays, calcium carbonate, talc, etc. as disclosed in U.S. Pat. No. 5,387,573. In a preferred embodiment of the invention, the inorganic particles are silica. The inorganic particles improve the separation of the laminated part of the protection layer from the unlaminated part upon printing.

In a preferred embodiment of the invention, the protection layer contains from about 5% to about 60% by weight inorganic particles, from about 25% to about 80% by weight polymeric binder and from about 5% to about 60% by weight of the organic particles, and an effective amount of at least one gloss-enhancing compound. UV absorbers can be used in some cases.

Preferably, the gloss-enhancing compounds are used in the protection layer in an amount of 0.04 $g/m^2$ to 2.0 $g/m^2$, preferably 0.07 $g/m^2$ to 0.40$g/m^2$.

In use, yellow, magenta and cyan dyes are thermally transferred from a dye-donor element to form an image on the dye-receiving sheet. The thermal head is then used to transfer the clear protection layer, from another clear patch on the dye-donor element or from a separate donor element, onto the imaged receiving sheet by uniform application of heat. The clear protection layer may further comprise one or more UV absorber in addition to the gloss-enhancing agent. The clear protection layer adheres to the print and is released from the donor support in the area where heat is applied.

Any dye can be used in the dye layer of the dye-donor element used in the method of the present process provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

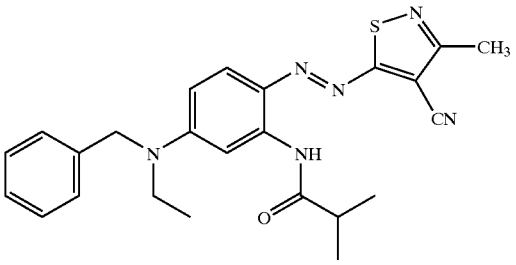

(magenta)

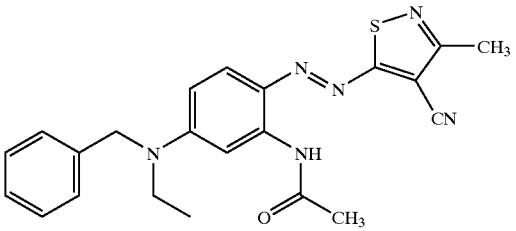

(magenta)

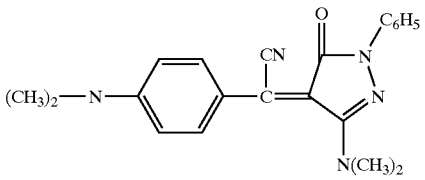

(magenta)

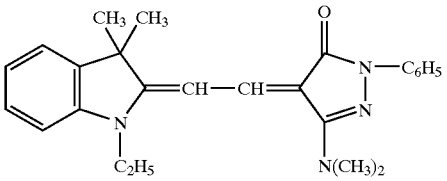

(yellow)

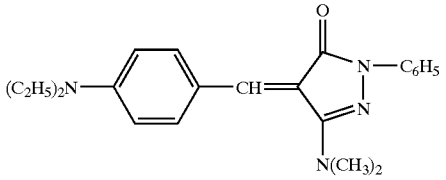

(yellow)

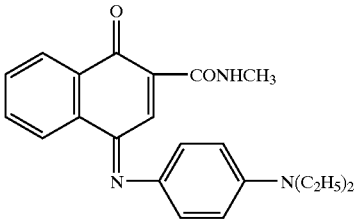

(cyan)

-continued

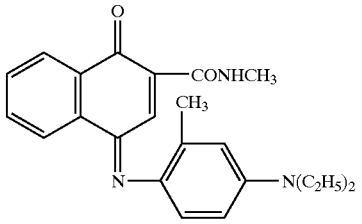

(cyan)

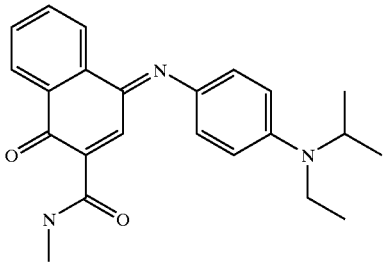

(cyan)

or any of the dyes disclosed in U.S. Pat. No. 4,541,830, the disclosure of which is hereby incorporated by reference. Other dyes are disclosed in U.S. Pat. Nos. 4,698,651; 4,695,287; 4,701,439; 4,757,046; 4,743,582; 4,769,360 and 4,753,922, the disclosures of which are hereby incorporated by reference. The above dyes maybe employed singly or in combination to obtain a monochrome. The dyes may be used at coverage of from about 0.05 to about 1 g/m$^2$ and are preferably hydrophobic.

A dye-barrier layer may be employed in the dye-donor elements used in the present process to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the backside of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

The dye-receiving element that is used with the dye-donor element usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount that is effective for the intended purpose. In general, good results have been obtained at a concentration of from about 1 to about 5 g/m$^2$.

As noted above, the dye donor elements are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Thus, one-, two-, three- or four-color elements (or higher numbers also) are included within the scope of the invention.

In a preferred embodiment of the process of the present invention, the dye-donor element may comprise a poly (ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads that can be used to transfer dye from dye-donor elements are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage typically comprises (a) a dye-donor element as described above, and (b) a dye-receiving element as described above, the dye-receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head.

After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

EXAMPLES

Receiving Element

Kodak Ektatherm® receiving element, Catalog #172-5514, was used in the printing technique outlined below to produce the images for measurement of gloss.

Printing:

Using Kodak Professional EKTATHERM XLS XTRALIFE Color Ribbon (Eastman Kodak Co. Catalog No. 807-6135) and a Kodak Model 98650 Thermal Printer, a Status A neutral density image with a maximum density of at least 2.3 was printed on the receiver described above. The color ribbon-receiver assemblage was positioned on a 18 mm platen roller and a TDK thermal head (No. 3K0345) with a head load of 6.35Kg was pressed against the platen roller. The TDK 3K0345 thermal print head has 2560 independently 15 addressable heaters with a resolution of 300 dots/inch and an average resistance of 3314Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 $\mu$sec every 76 $\mu$sec. Printing maximum density required 64 pulses "on" time per printed line of 5.0 msec. The voltage supplied was 13.6 volts resulting in an instantaneous peak power of approximately 58.18×10−3 Watt/dot and the maximum total energy required to print Dmax was 0.216 mJoules/dot. The process is repeated sequentially, yellow, magenta, cyan to obtain the desired neutral image.

Each of the protective layer elements described above was placed in contact with the polymeric receiving layer side of the receiver element containing the neutral density image described above. The printing process was used to heat the transferable protection overcoat uniformly with the thermal head to permanently adhere the transferable protection overcoat to the print. The print energy was varied by changing the head voltage and enable width. The donor support was peeled away as the printer advanced through its heating cycle, leaving the transferable protection overcoat adhered to the imaged receiver.

The gloss was determined at sixty degrees using a BYK-Gardner micro-TRI-gloss® meter. The aperture of the gloss meter was placed perpendicular to the direction of printing. (This method of determining the gloss value, or its equivalent, is referred to herein as the Gloss Test.)

COMPARATIVE EXAMPLES 1 TO 5

Control Element C-1

Protection layer donor elements were prepared by coating on the backside of a 6 μm poly(ethylene terephthalate) support:

1) a subbing layer of titanium alkoxide, Tyzor TBT®, (DuPont Corp.) (0.13 g/m$^2$) from a n-propyl acetate and n-butyl alcohol solvent mixture (85/15), and
2) a slipping layer containing an aminopropyl-dimethyl-terminated polydimethylsiloxane, PS512® (United Chemical Technologies) (0.01 g/m$^2$), a poly(vinyl acetal) binder, KS-1, (Sekisui Co.), (0.38 g/m$^2$), p-toluenesulfonic acid (0.0003 g/m$^2$) and candellila wax (0.02 g/m$^2$) coated from a solvent mixture of 3-pentanone, methanol and distilled water (88.7/9.0/2.3).

On the front side of the element was coated a transferable overcoat layer of poly(vinyl acetal), KS-10, (Sekisui Co.), at a laydown of 0.63 g/m$^2$, colloidal silica, IPA-ST (Nissan Chemical Co.), at a laydown of 0.46 g/m$^2$ and 4μm divinylbenzene beads at a laydown of 0.11 g/m$^2$. The materials were coated from the solvent 3-pentanone.

Control Element C-2

This element is the same as C-1 except the materials were coated from a solvent mixture of 4-methyl-2-pentanone and 1 -methoxy-2-propanol (86:14).

Examples 1 to 16

Inventive Element I-1 thru I-4

These elements are the same as C-1 with the addition to the transferable overcoat layer of CGP-1644 (Ciba Specialty Chemicals), a triazine, at a laydown of 0.08, 0.11, 0.16 and 0.32 g/m$^2$, respectively.

Comparative Element I-5 thru I-7

These elements are the same as C-1 with the addition to the transferable overcoat layer of Tinuvin® 1577FF (Ciba Specialty Chemicals), a triazine, at a laydown of 0.08, 0.16 and 0.32 g/m$^2$, respectively.

Inventive Element I-8 thru I-10

These elements are the same as C-1 with the addition to the transferable overcoat layer of Tinuvin® 328 (Ciba Specialty Chemicals), a benzotriazole, at a laydown of 0.08, 0.16 and 0.32 g/m$^2$, respectively.

Inventive Element I-11 thru I-13

These elements are the same as C-1 with the addition to the transferable overcoat layer of Cyasorb® UV11644 ® (Cytec Industries), a triazine, at a laydown of 0.08, 0.16 and 0.32 g/m$^2$, respectively.

Inventive Element I-14

This element is the same as C-2 with the addition to the transferable overcoat layer of CGP-1644 (Ciba Specialty Chemicals), a triazine, at a laydown of 0.16g/m$^2$.

Inventive Element I-15

This element is the same as C-2 with the addition to the transferable overcoat layer of Parsol 1789® (Roche Div. of Hoffman-LaRoche), a dibenzoylmethane, at a laydown of 0.16 g/m$^2$.

Comparative Example I-16

This element is the same as C-2 with the addition to the transferable overcoat layer of PC ADD UVA5® (Nitroil), a formamidine, at a laydown of 0.16 g/m$^2$.

TABLE 1

| Example ID | Organic Material | Organic Material Coverage (g/m$^2$) | 60° Mean Gloss (n = 6) |
|---|---|---|---|
| Control-1 | None | none | 73.9 |
| Control-2 | None | none | 76.1 |
| I-1 | CGP-1644 | 0.08 | 77.4 |
| I-3 | CGP-1644 | 0.16 | 79.9 |
| I-4 | CGP-1644 | 0.32 | 80.5 |
| Comp-5 | Tinuvin ® 1577FF | 0.08 | 76.1 |
| Comp-6 | Tinuvin ® 1577FF | 0.16 | 75.0 |
| Comp-7 | Tinuvin ® 1577FF | 0.32 | 75.4 |
| I-8 | Tinuvin ® 328 | 0.08 | 77.1 |
| I-9 | Tinuvin ® 328 | 0.16 | 79.6 |
| I-10 | Tinuvin ® 328 | 0.32 | 81.8 |
| I-11 | Cyasorb ® UV1164 | 0.08 | 77.6 |
| I-12 | Cyasorb ® UV1164 | 0.16 | 77.6 |
| I-13 | Cyasorb ® UV1164 | 0.32 | 75.8 |
| I-14 | CGP-1644 | 0.16 | 78.3 |
| I-15 | PARSOL ® 1789 | 0.16 | 79.2 |
| I-16 | PC ADD ® UVA5 | 0.16 | 77.8 |

The results in Table 1 indicate that incorporating a gloss enhancing material into the over-protective laminate formulation gives a significant increase in the observed and measured gloss of the final print.

Example 17

This example shows improved gloss from incorporation of an organic gloss-enhancing agent in the over-protective laminate according to the present invention at fast line time. Using KODAK Photo Printer Kit 6400® (Eastman Kodak Co. Catalog No. 180-2016) receiver with various test color ribbons and a KODAK Photo Printer 6400®, a Status A neutral density image with a maximum density of at least 2.3 was printed on the receiver described above.

The color ribbon-receiver assemblage was positioned on a 18 mm platen roller and a thermal print head with a load of 3.18 Kg pressed against the platen roller. The thermal print head has 1844 independently addressable heaters with a resolution of 300 dots/inch and an average resistance of 4800 ohms. The imaging electronics were activated when an initial print head temperature of 37° C. had been reached. The assemblage was drawn between the printing head and platen roller at 70.5 mm/sec (1.2 ms line time) for yellow, magenta, cyan, and clear protective coat layer. Printing maximum density required a duty cycle of 90% "on" time per printed line. The voltage supplied was 25 volts resulting in an instantaneous peak power of approximately 0.131 Watts/dot and the maximum total energy required to print Dmax was 0.1216 mJoules/dot for the sequential printing process of yellow, magenta, cyan and over-protective laminate to obtain the desired neutral image. The gloss of the prints was measured after application of the heat transferable over-protective layer.

The laminate formulations used in this aspect of the formulation are those described as control C-1 and inventive element I-2 above.

Table 2 below shows the results for gloss with a gloss-enhancing agent ("GEA") in this case Material COP 1644, a triazine compound, at fast line time, specifically in this test at a line time 1.2 msec.

TABLE 2

| GEA Coverage $g/m^2$ | 60 Degree Gloss |
|---|---|
| 0 | 73.8 |
| 0.11 | 77.1 |

The data given in Table 2 above indicates that incorporating a gloss-enhancing agent, such as CGP 1644, increases the gloss at fast line times.

What is claimed is:

1. A process of forming a protection layer with an improved level of gloss on top of a thermal dye transfer image in a thermal print comprising: (a) imagewise-heating a dye-donor element comprising a support having thereon a dye layer comprising an image dye in a binder, said dye-donor element being in contact with a dye-receiving element, thereby transferring a dye image to said dye-receiving element at a line time of 0.4 to 2 milliseconds to form said dye transfer image; and (b) thermally transferring a protection layer on top of said transferred dye image at a line time of 0.4 to 2 milliseconds; said protection layer comprising an effective amount of at least gloss-enhancing compound that consists of an organic molecule that is essentially colorless, does not scatter light, is substantially not absorbing of light at a wavelength from 400 to 800 nm, and has a maximum absorption at a wavelength less than 400 nm.

2. The process of claim 1 wherein the gloss of the transferred protection layer is less than 69 in the absence of said at least one gloss-enhancing compound and at least 72–85 or greater in the presence of the gloss-enhancing compound.

3. The process of claim 2 wherein the gloss-enhancing compound provides an improvement in gloss, as measured by the Gloss Test, of at least 2 gloss units.

4. The process of claim 3 wherein there is an improvement in gloss of at least 3 gloss units as measured.

5. The process of claim 1 wherein the gloss-enhancing compound is a benzotriazole or triazine.

6. The process of claim 1 wherein the line time is 0.5 to 1.4 milliseconds in (a) and (b).

7. The process of claim 1 wherein the Tg of the surface material on the protection layer in contact with the dye-receiving element is in the range of 100 to 125° C.

8. The process of claim 7 wherein the Tg of the surface material is below 120° C.

9. The process of claim 1 wherein the protection layer is heated by the thermal head at a temperature of 130 to 150° C.

10. The process of claim 1 wherein the thermal print, as measured by a Gloss Test, has a gloss of at least 70.

11. The process of claim 1 wherein the process employs a single print thermal head.

12. The process of claim 1 wherein at least the surface material of said protection layer comprises a polymer represented by the following structure:

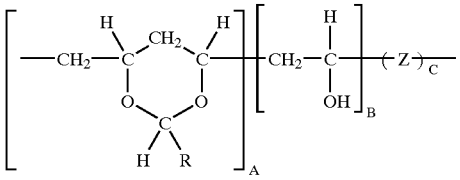

wherein:

R is H, $CH_3$ or $C_6H_5$;

A is at least about 25 mole percent;

B is from about 5 to about 75 mole percent;

Z is another monomer different from A and B such as vinyl acetate, vinyl chloride, styrene, methyl methacrylate, butyl acrylate, isopropyl acrylamide, and acrylate ionomer;

A+B is at least about 65 mole percent; and $$A+B+C=100.$$

13. The process of claim 1 wherein at least a surface material of said protection layer comprises a polymer selected from the group consisting of poly(vinyl formal), poly(vinyl benzal) or poly(vinyl acetal) containing at least about 5 mole % hydroxyl, poly(vinyl)butyral, and poly (methylmethacrylate), and combinations thereof.

14. The process of claim 13 wherein at least a surface material of said transferable protection layer comprises poly(vinyl acetal).

15. The process of claim 1 wherein said dye-donor element is a multicolor element comprising repeating color patches of yellow, magenta and cyan image dyes, respectively, dispersed in a binder, and a patch containing said protection layer.

16. The process of claim 1 wherein separate thermal print heads are employed for imagewise heating in step (a) and non-imagewise heating in step (b).

17. The process of claim 16 wherein a plurality of separate thermal print heads are employed for imagewise heating, respectively, a plurality of color patches in step (a).

* * * * *